US006092883A

United States Patent [19]

Lechman

[11] Patent Number: 6,092,883

[45] Date of Patent: Jul. 25, 2000

[54] WORK STATION FOR FLAT MONITORS

[75] Inventor: John N. Lechman, Effingham, Ill.

[73] Assignee: Nova Solutions, Inc., Effingham, Ill.

[21] Appl. No.: 08/902,455

[22] Filed: Jul. 29, 1997

Related U.S. Application Data

[63] Continuation-in-part of application No. 08/451,027, May 31, 1995, Pat. No. 5,651,594.

[51] Int. Cl.[7] ..... A47B 81/06

[52] U.S. Cl. ..... 312/194; 312/223.3

[58] Field of Search ..... 312/194, 223.3, 312/223.2

[56] References Cited

U.S. PATENT DOCUMENTS

| | | | |
|---|---|---|---|
| Re. 34,266 | 6/1993 | Schairbaum . | |
| 1,842,991 | 1/1932 | MacIntosh . | |
| 2,464,856 | 3/1949 | Finley . | |
| 4,440,457 | 4/1984 | Fogelman et al. | 312/223.3 |
| 4,590,866 | 5/1986 | Schairbaum . | |
| 4,755,009 | 7/1988 | Price et al. . | |
| 4,934,643 | 6/1990 | Militano, Jr. . | |
| 5,071,204 | 12/1991 | Price et al. | 312/194 |
| 5,087,010 | 2/1992 | Walters . | |
| 5,125,727 | 6/1992 | Lechman et al. . | |
| 5,199,773 | 4/1993 | Price, Jr. et al. . | |
| 5,205,631 | 4/1993 | Wegman et al. . | |
| 5,232,276 | 8/1993 | Martin | 312/223.3 X |
| 5,290,099 | 3/1994 | Lechman . | |
| 5,294,193 | 3/1994 | Wegman et al. | 312/223.3 |
| 5,364,177 | 11/1994 | Ugalde . | |
| 5,408,939 | 4/1995 | Lechman | 312/223.3 X |
| 5,410,972 | 5/1995 | Schairbaum . | |
| 5,572,935 | 11/1996 | Schairbaum | 312/223.3 X |
| 5,651,594 | 7/1997 | Lechman | 312/223.2 X |
| 5,699,744 | 12/1997 | Lechman | 312/194 X |
| 5,762,409 | 6/1998 | Rice, Jr. | 312/223.3 X |

FOREIGN PATENT DOCUMENTS

| | | |
|---|---|---|
| 1106895 | 8/1981 | Canada . |

*Primary Examiner*—Peter M. Cuomo
*Assistant Examiner*—Stephen Vu
*Attorney, Agent, or Firm*—Olson & Hierl, Ltd.

[57] ABSTRACT

A flat monitor is associated with a work station in inset relationship to the top surface of the work station's platform so as to be non-interfering with this top surface usage. The flat monitor is supported in a compartment structure associated with an opening in the platform. The compartment and the flat monitor are preferably provided with a transparent sheet extending over the platform opening.

13 Claims, 7 Drawing Sheets

WORK STATION FOR FLAT MONITORS

RELATED APPLICATION

This application is a continuation-in-part of my earlier filed U.S. patent application Ser. No. 08/451,027 filed May 31, 1995 now U.S. Pat. No. 5,651,594 issued Jul. 29, 1997.

FIELD OF THE INVENTION

The present invention relates to work stations for use with computer monitors.

BACKGROUND OF THE INVENTION

It is heretofore known to provide a transparent surface portion on the top of a desk or other work station for use with a cathode ray tube or monitor. The cathode ray tube is positioned under the desk top for viewability through the transparent surface so that the top of the work station is not obstructed by the cathode ray tube. Such devices also may include adjustable assemblies for supporting the monitor underneath the desk to enable the user to tilt and raise or lower the monitor to enhance the user's comfort. Examples of prior art work stations and work station assemblies with monitor supports are disclosed in U.S. Pat. No. Re. 34,266 to Schairbaum, No. 4,755,009 to Price et al., No. 5,125,727 to Lechman et al., No. 5,290,099 to Lechman, and No. 5,205,631 to Wegman et al.

A shortcoming of such prior art devices is that virtually all are designed for use with computers that utilize cathode ray tube monitors. In light of the increasing popularity of and practicality of so-called flat monitors (also known as flat panel displays), however, a work station is needed that is designed especially for use with flat computer monitors. Desirably, such a work station would desirably accommodate differing desired or needed spatial dimensions and orientations of a flat monitor that is supported by the work station.

The present invention overcomes this shortcoming and achieves a work station for flat monitors with such desired features.

SUMMARY OF THE INVENTION

The present invention provides a work station adapted to be used with a flat monitor. The work station generally comprises a work table or platform with means for platform support in upwardly spaced relationship relative to a floor surface. Preferably, a keyboard tray is slidingly engaged with the work station so as to be extensible and retractable relative to one side of the work station adjacent to the platform. If desired, the work station can include a shelf or a drawer means for housing a central processing unit (CPU) which can be a laptop or notebook type of computer. The platform support means can be a plurality of walls or panel support members that define a knee-hole region and an adjacent a drawer or storage region.

In accordance with one preferred embodiment of the invention, a bore or recess having a bottom surface is formed in the top surface of the work table platform for receiving and supporting a flat monitor. If desired, a sheet of glass or other rigid transparent material may be hingedly connected to the top surface of the work table platform adjacent the bore for encasing or covering the flat monitor when it is positioned within the bore.

In accordance with further embodiments of the invention, a through opening or aperture is formed in the work table platform, and an adjustable flat monitor support assembly is provided that is adapted to support a flat monitor beneath the work table platform for viewability through the opening. The support assembly comprises generally a flat support member that can, if desired, be hingedly connected to the bottom of the work table platform adjacent the opening. A lip can extend upwardly from the support member at an angle of perhaps approximately 90 degrees to further support the monitor. Means can also be provided for pivoting the support member, such as a pair of arms that adjustably connect the support member to the walls of the work station. If desired, the pivoting means may be responsive to the inward and outward sliding of the keyboard supporting tray.

The monitor support assembly may be formed of sheet metal, plastic sheeting, or interwelded heavy wire components to make the assembly light in total weight and also provide excellent capacity for air circulation for monitor cooling purposes.

The work station in accordance with a further embodiment of the invention includes an opening formed in the work table, and a monitor support member that extends from the proximal end of the keyboard tray at an upward angle. By sliding the keyboard tray outward, the monitor support member can be positioned so that the flat monitor can be viewed through the opening. This embodiment is intended for use with one-piece commercial flat monitor computers, such as a so-called laptop type of computer, wherein the flat monitor is mounted in the pivotally associated cover of a base which holds a keyboard and central processing unit components.

The work station in accordance with the present invention offers a substantial advance in the art because it is designed for use with a flat monitor. Since the flat monitor can be positioned below or flush with the top surface of the work station platform, the surface is not obstructed by the monitor. Moreover, the adjustable supporting means, if included, accommodates differing sizes, spatial positions, and orientations of the flat monitor for enhancing viewing comfort and capability.

Accordingly, it is an object of this invention to provide a work station with a compartment in its platform for use with flat computer monitors.

It is further object of this invention to provide such a work station that includes means for supporting the flat monitor beneath the top surface of the work station platform so that the flat monitor can be viewed through an open or a transparent portion of the top surface.

It is further object of this invention to provide such a work station where the means for supporting the flat monitor is adjustable to accommodate differing orientations and sizes of the flat monitor.

Other and further objects, arms, features, purposes, advantages, applications, embodiments and the like will be apparent to those skilled in the art from the present disclosure including the specification, accompanying drawings, and appended claims.

BRIEF DESCRIPTION OF THE DRAWINGS

The present invention and the features and advantages thereof will become more apparent upon consideration of the following detailed drawings, particularly when taken in conjunction with the accompanying specification and claims, in which:

DETAILED DESCRIPTION

Figure 1:
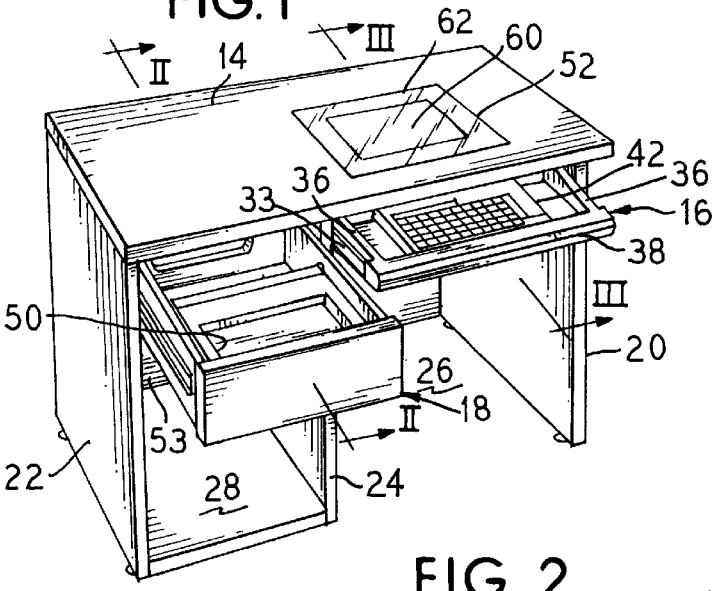
FIG. 1 is a perspective view of one illustrative embodiment of a work station in accordance with the invention.

An illustrative work station in accordance with the preferred embodiments of the invention is in the form of a desk 10 that comprises a work table or platform 12 having top and bottom surfaces 14, 15, a keyboard tray 16, and, if desired, a drawer 18 for housing the central processing unit (CPU). The work table is supported by a pair of side walls 20, 22 and a central wall 24, which define a knee-hole region 26 and a drawer region 28.

Preferably, the keyboard tray 16 comprises two opposed lateral sides 36 and proximal and distal sides 34, 38. The keyboard tray may be slidingly engaged with the desk in any suitable manner so that it slides from a first position in which it is disposed substantially within the knee-hole region 26 to a second position in which it is disposed outwards from the knee-hole region. In the illustrated embodiments, for example, the keyboard tray 16 is connected to side wall 20 and central wall 24 by respective ones of a pair of horizontally-extending slide members 30 which are each secured to walls 20 and 24 which slidingly engage respective ones of a pair of horizontally-extending rails 32 which are each secured to a different one of the opposed sides 36 of the keyboard tray 16. A plurality of rollers (not shown) may be rotatably secured to the rails and received by the slide members in accordance with conventional drawer assemblies.

Preferably, a portion of each of the rails 32 extends from the proximal side 34 of the keyboard tray 16 to increase the outward extension of the tray 16 relative to the knee-hole region 26. The opposed sides 36 of the keyboard tray 16 may be sloped upward from the distal side 38 to the proximal side 34 of the tray to complement a similarly-sloping keyboard 42 (see FIG. 3).

The drawer 18 may be slidingly engaged to the desk 10 in any suitable manner so that it slides from a first position in which it is substantially disposed within the drawer region 28 to a second position in which it is extended outwardly from the front position. In the illustrated embodiments, for example, the desk 10 is slidably connected to side wall 22 and to central wall 24 in substantially the same manner as the keyboard tray 16 is secured to side wall 20 and the central wall 24, with horizontally-extending slide members 30' slidingly engaging the horizontally-extending rails 32'. The rails 32' do not extend from the proximal side 34' of the drawer, however, because it is typically not desirable for the drawer 18 to extend completely outside of the drawer storage region. If desired, the drawer 18 may include a generally rectangular cavity 50 formed in the bottom surface of the drawer 18 for securably receiving a CPU, such as a laptop computer or the like (not shown). One or more apertures 51 may be formed in the proximal side 34' of the drawer 18, the central wall 24, and a back wall 53 of the desk 10 to receive necessary or desirable electric cables 55.

Figure 2:
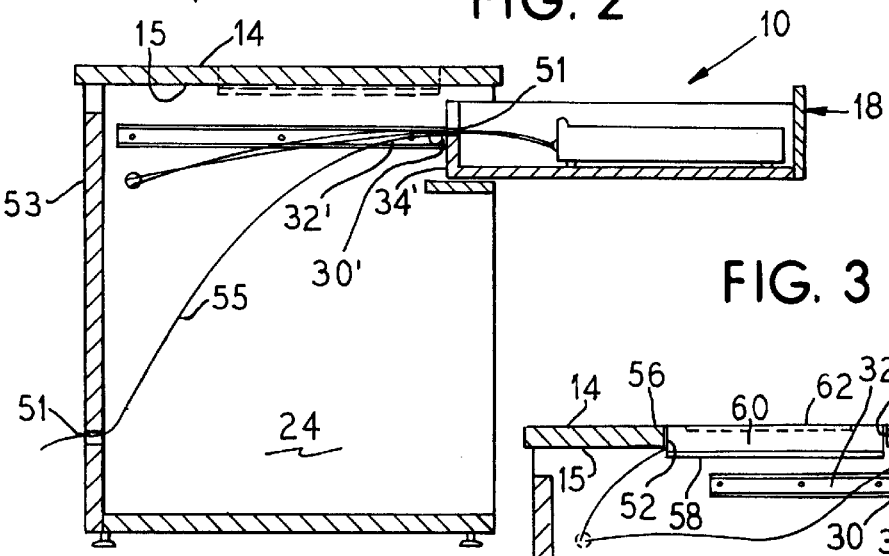
FIG. 2 is a vertical transverse sectional view taken along the line II—II of FIG. 1.
Figure 3:
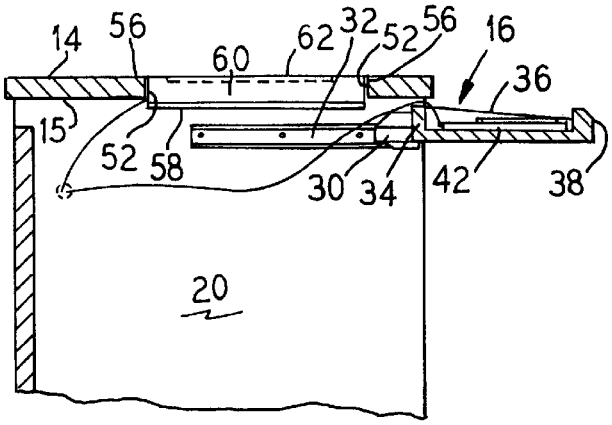
FIG. 3 is a fragmentary vertical transverse sectional view taken along the line III—III of FIG. 1.

In accordance with the first embodiment of the invention which is shown in FIGS. 1–3, a compartment or bore 52 preferably having a quadrilateral side perimeter for receiving and supporting a flat monitor 60 is formed in the top surface 14 of the work table platform 12. Preferably, the perimeter of the bore or compartment 52 is generally rectangular, and is defined by four side walls 56. Bore or compartment 52 includes a bottom plate that defines a bottom surface 58 that is disposed slightly below the work table platform 12. The depth of the bore 52 desirably exceeds or is substantially the same as the conventional height of a flat monitor 60. One or more apertures, for example, apertures can be formed in the bore 52 to receive electric cables for supplying power to the monitor 60.

A sheet or plate 62 of glass or other transparent material may be included to cover and encase the monitor 60 when it is disposed in the bore 52. The top surface of the sheet is substantially flush with the top surface 14 of the work table platform 12. Preferably, the sheet 62 is hingedly connected to the top surface 14 adjacent one side 56 of the bore 52 so that the sheet 62 can be pivoted from an open to a closed position for placement and removal of the monitor 60.

Figure 4:
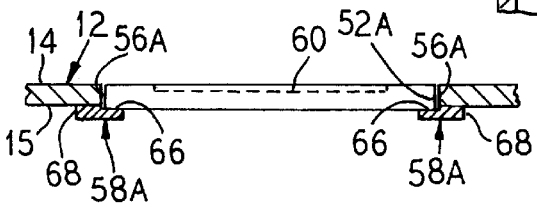
FIG. 4 is a fragmentary vertical transverse view similar to FIG. 3, taken through a portion of the work platform, illustrating a modified form of the work station embodiment shown in FIGS. 1–3.
Figure 5:
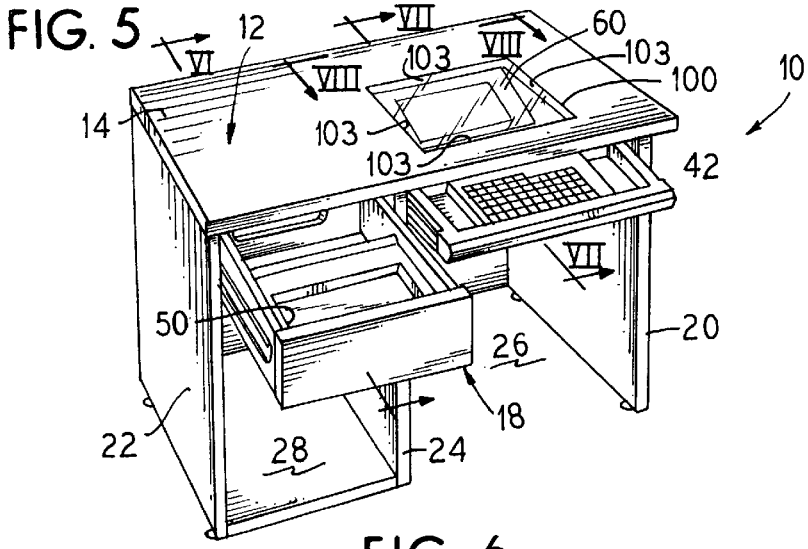
FIG. 5 is a perspective of a work station in accordance with an alternative embodiment of the invention.
Figure 6:
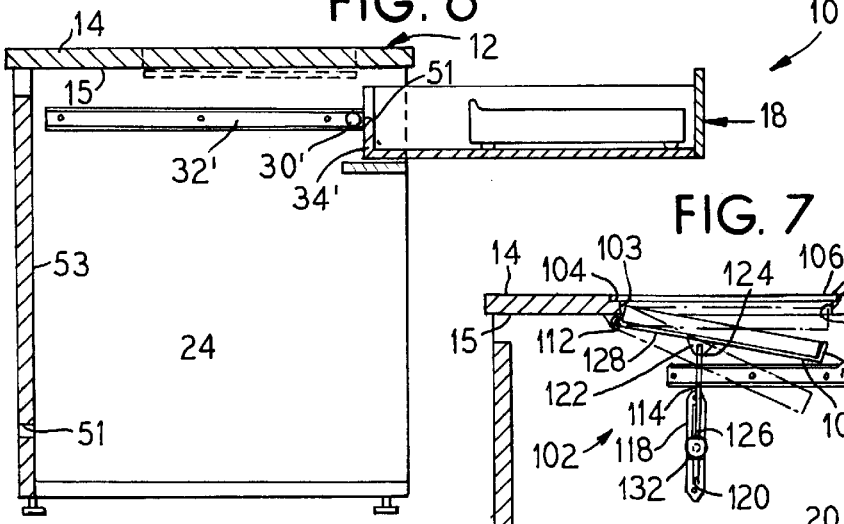
FIG. 6 is a vertical transverse sectional view taken along the line VI—VI of FIG. 5.

FIG. 4 illustrates a modification of the first embodiment of the invention wherein the bore 52A is alternatively defined by four side walls 56A, and a ledge 58A extending around the periphery of the bore 52A just beneath and adjacent to the work table 12 for supporting the monitor 60. The ledge 58A is defined by a shoulder member 66 that is integral with a base member 68, with the base member 68 being secured to the bottom surface 15 of the work table platform 12 adjacent the bore 52A so that the shoulder member 66 extends beyond walls 56A slightly beneath the work table platform 12 thereby defining the bottom of bore 52A. The base member 68 may be secured to the bottom surface 15 of the work table 12 in any suitable manner, such as by the use of fasteners or an adhesive.

FIGS. 5–8 illustrate a second embodiment of the invention wherein a generally rectangular through opening 100 is formed in the work table 12, and an adjustable assembly 102 is provided for supporting the flat monitor 60. In this embodiment, the opening 100 is defined by four side walls 103. If desired, a generally rectangular recess or lip 104 may be formed in the top surface 14 of the work table 12 immediately adjacent the periphery of the opening (see FIGS. 7–8). The recess 104 is for receiving and supporting a sheet of glass 106 or other transparent material having a top surface substantially flush with the top surface of the work table 12. Preferably, the sheet 106 is hingedly connected to the top surface 14 adjacent to one side wall 103 of the opening 100 so that it can pivot from an open to a closed position covering the opening 100 for placement and removal of the monitor 60 as supported by assembly 102.

Figure 7:
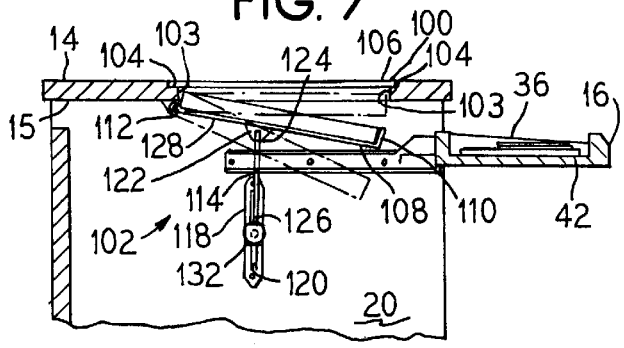
FIG. 7 is a fragmentary vertical transverse sectional view taken along the line VII—VII of FIG. 5.

The assembly 102 comprises a substantially flat support member 108 having a lip 110 extending upward from the support member 108 at an angle of approximately 90 degrees, as shown in FIG. 7. The proximal side 112 of the support member 108 is hingedly connected to the bottom surface 15 of the work table 12 adjacent the opening 100 so that the support member can pivot toward the opening. The support member 108 further comprises a pair of arms 114 which adjustably connect the opposed sides 116 of the support member 108 to a pair of brackets 118 secured, respectively, to side wall 20 and the central wall 24. Desirably, each of the brackets 118 are vertically mounted to these walls 20 and 24 and each bracket 118 has an elongated, vertically-oriented slot 120 formed therein (see FIG. 7).

Figure 8:
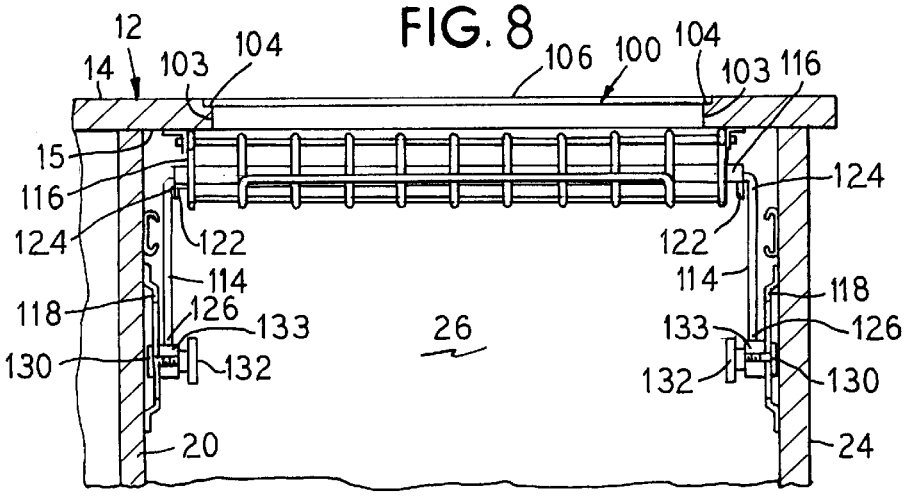
FIG. 8 is a fragmentary vertical longitudinal sectional view taken along the line VIII—VIII of FIG. 5.

One end 124 of each arm 114 is pivotally connected to a down-turned ear or boss 122 mounted to the opposed sides 113 of the bottom (not shown) of the support member 108 at the approximate center of the length of the support member. The other end 126 of each arm 114 is adjustably secured to one of the brackets 118 in any suitable manner, such as by a carriage bolt 130 slidingly engaged with slot 120 and a knob 132 having a projecting base, as shown in FIGS. 7 and 8. With this construction, the other end 126 of each of the arms 14 terminate in a clamp or brace 133 that also defines an internally-threaded horizontal passage for slidably engaging the base of the knob 132. An internally-threaded axial bore (not detailed) is formed in the knob 132, and the threaded shank of the bolt 130 extends through the elongated slot 120 formed in the bracket 118 and through the passage in the brace 133 and is received within the bore of the knob 132 for screwing engagement therewith.

With this embodiment, the support member 108 is first oriented at a desired angle, causing the bolt 130 and knob 132 assembly to slide along the elongated slot 120 to the desired location. The knob 132 and bolt 130 assembly is then locked in place by rotating the knob 132, which causes the bolt 130 and knob 132 to lock together at the desired location along the slot 120. Thereafter, the knob 132 and bolt 130 assembly can be unlocked by rotating the knob 132 in the reverse direction and the support member 108 can be repositioned to a different angle.

Figure 9:
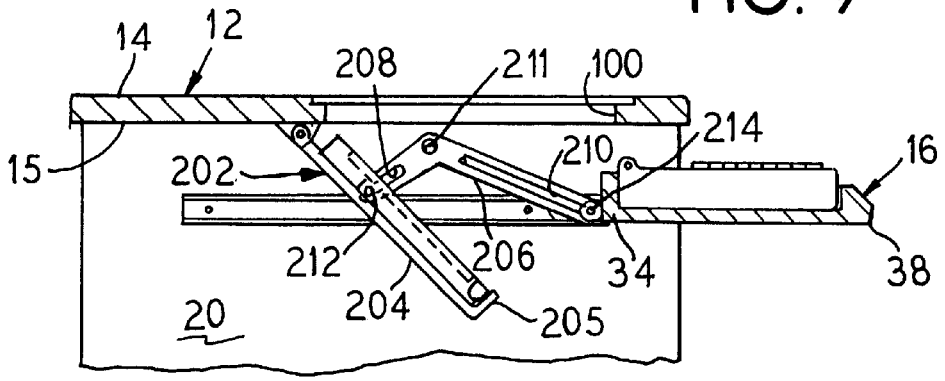
FIG. 9 is a view similar to FIG. 7 but showing an alternative embodiment of the flat monitor support assembly.
Figure 10:
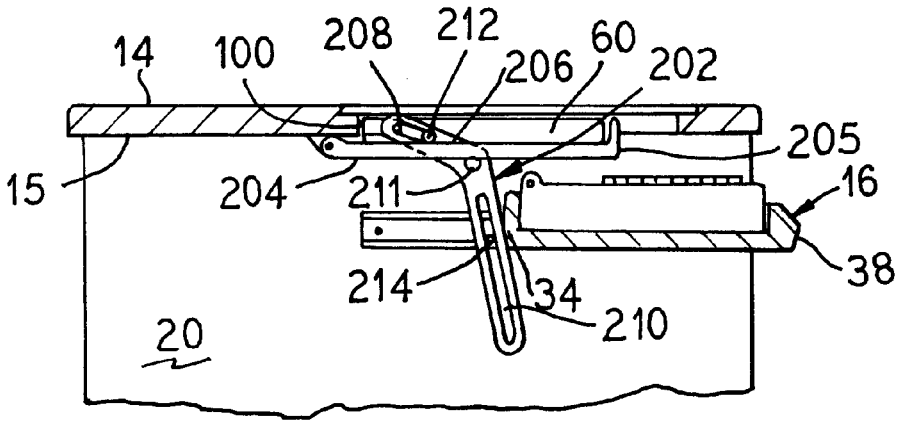
FIG. 10 is a further view of the flat monitor support assembly of FIG. 9, but illustrating the flat monitor support assembly in a storage configuration.

FIGS. 9 and 10 illustrate a modification of the second embodiment of the adjustable monitor support assembly generally designated here as 202. With this embodiment, a support member 204 is pivotally connected adjacent the opening 100 so that the support member can pivot towards the opening. A lip 205 extends from the unattached side of the support member at angle of approximately 90 degrees.

A pair of levers 206 adjustably secures the flat monitor 60 to the keyboard tray 16 in a manner such that the support member pivots downward in response to outward sliding of the keyboard tray, and upward in response to inward sliding of the keyboard tray. Desirably, when the keyboard tray 16 is moved to its first position, the monitor is substantially horizontal and received within the opening.

The levers 206 preferably are bent with elongated slots 208, 210 formed on each side of the bends. The levers are pivotally secured to wall at its bend by lugs 211, defining a fulcrum. A first pin 212 extends from each side of the monitor 60 and is slidingly received within one of the first elongated slots 208 of levers 206. A second pin 214 extends from the proximal side 34 of the keyboard tray 16 adjacent the opposed lateral sides 36 and is slidingly received within one of the second elongated slots 210 of the levers.

Figure 11:
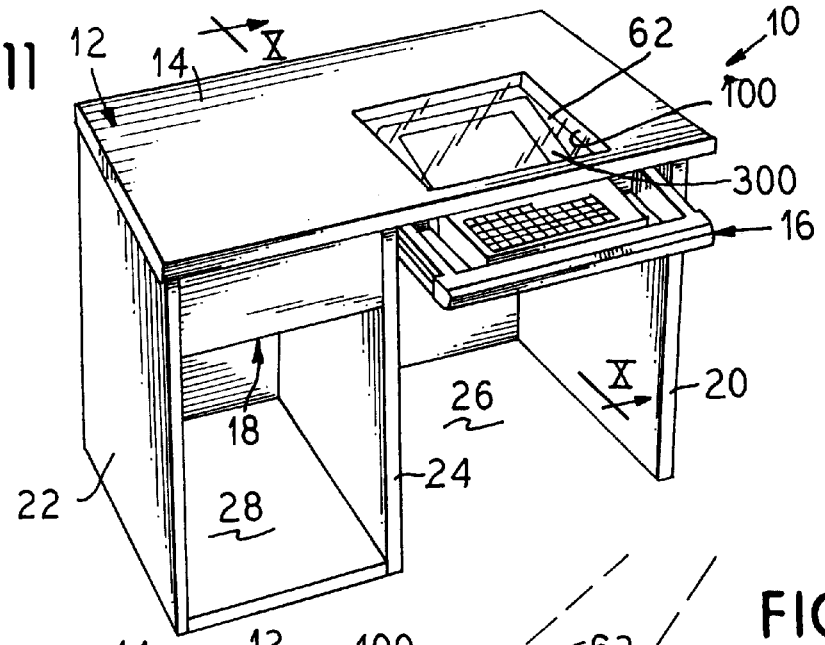
FIG. 11 is a perspective of a work station in accordance with another alternative embodiment of the invention.
Figure 12:
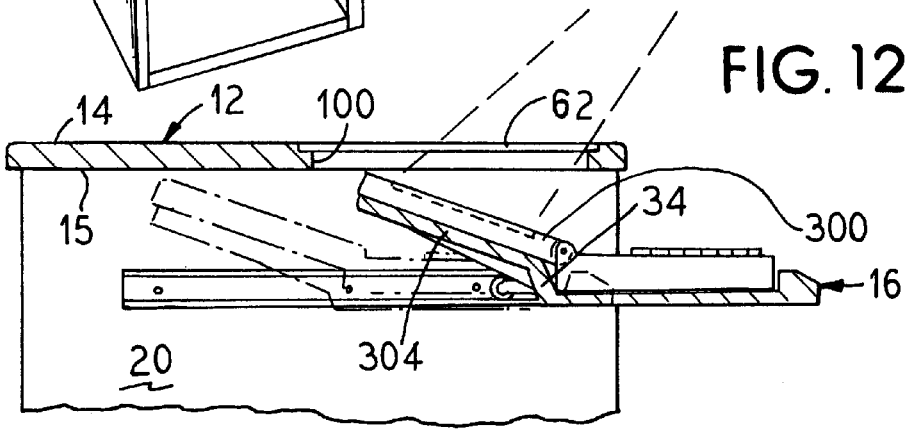
FIG. 12 is a vertical transverse sectional view taken along the line X—X of FIG. 11.

FIGS. 11 and 12 disclose a further embodiment of the invention that is especially suited for one-piece commercial flat monitor personal computers 300. In this embodiment, the opening 100 is formed in the work table 12, and a support member 304 extends from the proximal side 34 of the keyboard tray 16 for supporting the flat monitor 300. Preferably, the support member 304 is integral with the proximal wall 34 of the keyboard tray, and extends at an upward angle relative to the bottom of the keyboard tray that is in the range of 15 to 45 degrees and may be adjustable. Preferably, the proximal wall 34 extends at an angle in the range of 45 to 90 degrees relative to the bottom of the keyboard tray.

If desired, any of the components of the above described embodiments, such as the bottom surface of the bore 52 or the support assemblies 102, 202 may be formed of inter-welded heavy wire components to make the assembly light in total weight and also provide excellent capacity for air circulation for monitor cooling purposes (see e.g. FIG. 8).

Figure 14:
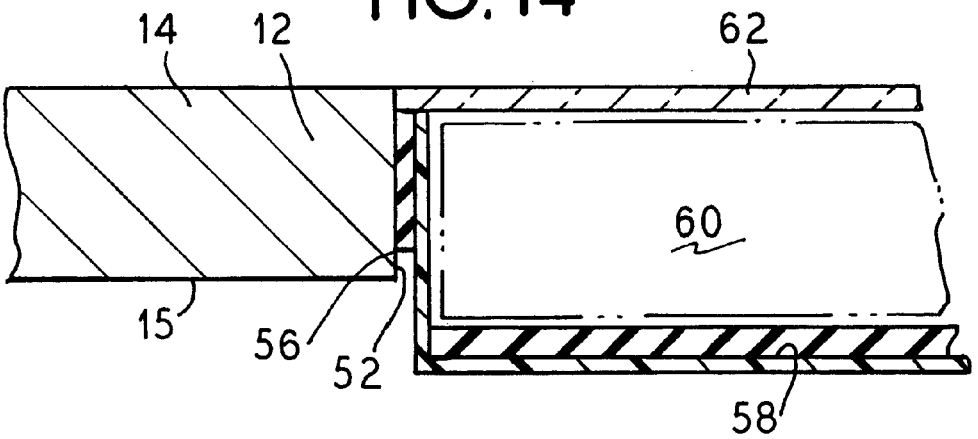
FIG. 14 is an enlarged fragmentary view of a portion of the platform and adjoining compartment structure shown in FIG. 3.
Figure 13:
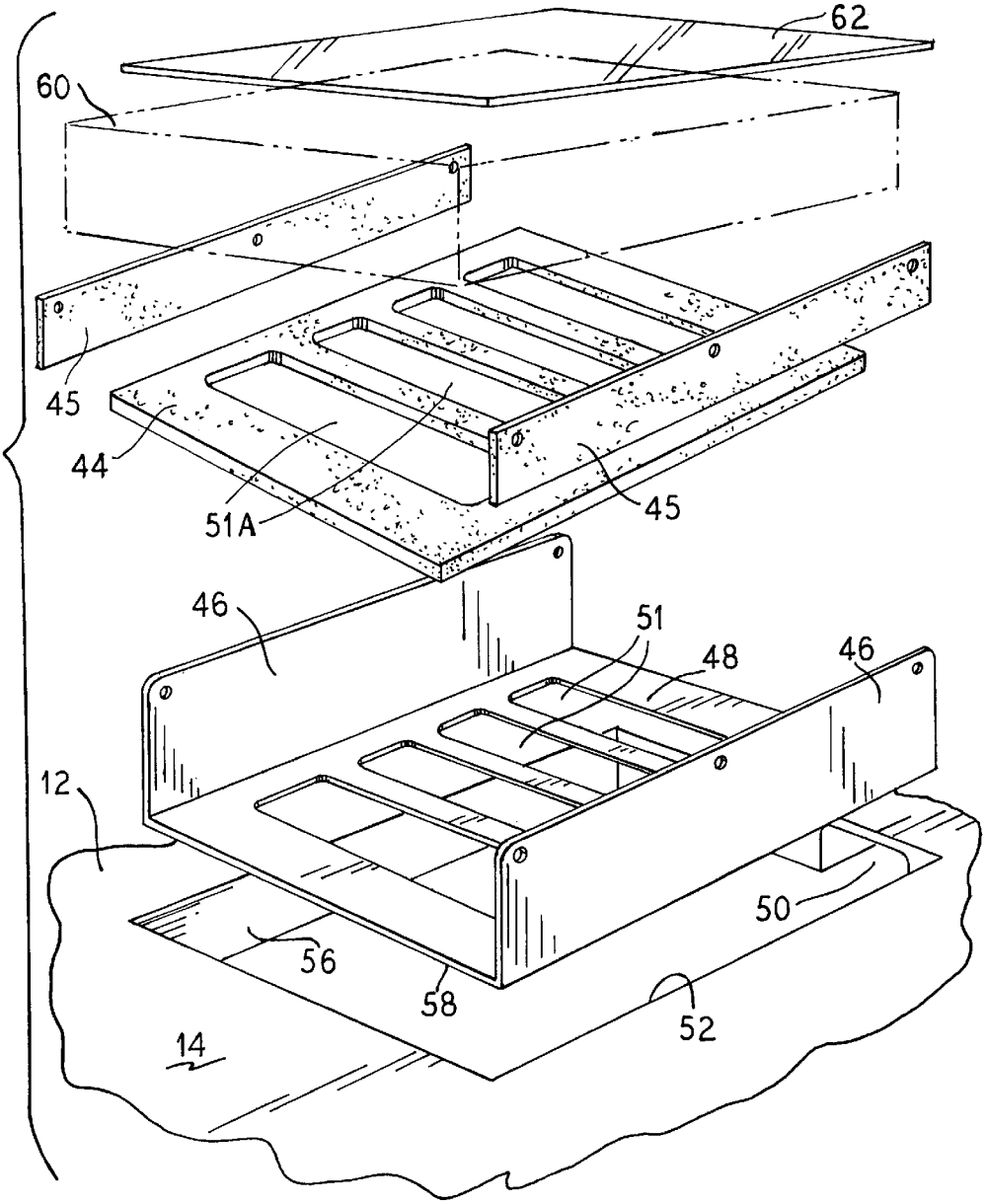
FIG. 13 is an enlarged, fragmentary exploded perspective view of the compartment structure shown in FIG. 3.

Structural details of the embodiment shown in FIGS. 1–3 are further illustrated in FIGS. 13 and 14. The flat monitor 60 is supported on bottom surface 58 which is defined by a generally flat member 48 that extends across bottom portions of the compartment 52. The flat member 48 has interconnected upturned flanges 46 (pair) defined along a pair of opposed side portions of the flat member 48, here illustratively the forward and rear opposed sides of flat member 48. Each flange 46 is about adjacent to a different opposed perimeter side wall 56 of compartment 52 as defined in the platform 12. Each flange 46 includes preferably conventional fastening means, here not detailed, but conveniently either mechanical (such as screws, nails, or the like, that extend through channels 49 defined in the flanges 46, and that pass through adjacent walls 56 into platform 12) or an adhering substance (such as an adhesive or the like). The fastening means mounts the flanges 46 to adjacent portions of perimeter walls 56. Thus, the flat member 48 is in effect suspended from a pair of opposed perimeter wall portions of a quadrilaterally configured compartment 52 defined in platform 12.

Those skilled in the art will appreciate that the flat member 48 can have various alternative side flanges. For example, the flat member 48 can have flanges along all of its side portions and the flat member can have various predetermined configurations which preferably are associatable with variously configured compartment perimeters. The flat member 48 and the side flanges 46 are preferably integrally formed with one another and can, for example, be pan-configured in perspective view or C-configured in vertical sectional view. Preferably, the flanges are provided in pairs on opposite side or edge portions of the flat bottom member 48.

Preferably, the flat bottom member 48 has apertures, such as apertures 51, defined therein for providing cooling for flat monitor 60 and for providing cable access, if desired, depending upon the particular structure of the flat monitor being employed.

The flat bottom member 48 and its flanges such as flanges 46 can be variously comprised of sheet metal, or rigid plastic sheeting, that is formed or molded, or comprised of interwelded wire members (see, for example, FIG. 8).

Preferably, the compartment structure utilizes pad means disposed upon upper surface portions of the flat bottom member 48. In the preferred embodiment shown in FIGS. 3, 13 and 14, a pad 44 is located generally over substantially all of such upper surface portions of flat bottom member 48. Preferably, such pad 44 is provided with apertures 51A which are at least in partial registration with the apertures 51 provided in the flat bottom member 51. Preferably, the pad 44 is bonded to the flat bottom member 51 by an adhesive or the like (not shown).

The pad 44 provides, among other utilities, a desirable cushion and shock and vibration absorbing medium for the flat monitor 60 relative to the work station or desk 10 and the working environment generally. The pad 44 can be a felted material, a foamed elastomer, a resilient plastic layer, or the like, as desired.

Conveniently and preferably, outside surface portions of the upturned flanges 46 have associated flange pads 45 which preferably extend continuously therealong. The pads 45 on flanges 46 are thus interposed between the flanges 46 and the adjacent perimeter side wall portions 56 in the assembled configuration. The pads 45 preferably help provide shock and vibration absorbing capacity, and also help provide a secure or solid mounting between the flanges 46 and the platform 12. Further, the pad 45 aids in providing a ledge surface upon which to rest edge portions of the transparent sheet 62. Thus, the sheet 62 can be, if desired, in vertically adjacent but slightly spaced relationship relative to a flat monitor 60 that is positioned upon the flat bottom member 48. The vertical width of the flanges 46, the dimensions of the flat member 48, and the thickness of the pad 44 and the thickness of the sheet 62 are in effect variables which can be regulated as desired so as to achieve a desired interrelationship with a particular flat monitor or class of flat monitors with which the present invention is to be utilized, as those skilled in the art will appreciate.

Preferably, the sheet 62 so associates with the other components adjacent thereto that the outer or upper surface of the sheet 62 is substantially flush with the top surface 14 of platform 12.

Optionally, as those skilled in the art will appreciate, the embodiment of FIGS. 1–3, 13 and 14 can be utilized without a sheet 62, if desired. In such a configuration, the dimensional arrangement between components is such that the front face of the flat monitor 60 is preferably substantially flush with the platform 12 surface 14. Also, the dimensional arrangement is such that the flat monitor 60 preferably substantially almost completely fills the cavity defined by the compartment 52 so that only a small gap exists between the sides of the flat monitor 60 and the adjacent sides of the compartment 52 so as not to interfere appreciably with the continuous top surface 14.

Figure 15:
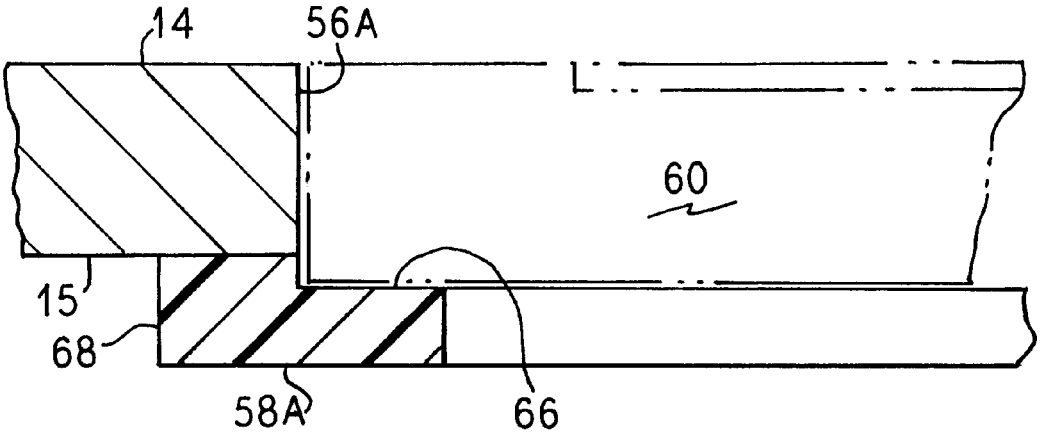
FIG. 15 is an enlarged fragmentary view of a portion of the platform and adjoining compartment structure shown in FIG. 4.

Structural details of the embodiment shown in FIG. 4 are further illustrated in FIG. 15. As above indicated, here the flat monitor rests upon the shoulder 66 of a base member 68 which is itself secured by an adhesive, or by screws, nails or the like, about the perimeter of the compartment 52 along the adjacent bottom surface 16 portions of platform 12. If desired, the configurations of the shoulder 66 and the bore member 68 can be chosen so that a transparent sheet (not shown) can fit over the upper surface of the monitor 60 with the sheet outer surface being flush with the platform 12 surface 14. The central dotted line extending across and adjacent to the upper surface of the monitor 60 shown in FIGS. 4 and 15 indicates the viewing screen position of the monitor 60.

Referring to FIGS. 16–21, there is seen an alternative embodiment of a compartment structure of the type shown in FIG. 4. Corresponding parts are similarly numbered. Here, the ledge 58A is structured so that the monitor 60 is received within the compartment 52 and a channel 40 is defined about the perimeter walls adjacent to the top surface 14 of platform 12. The channel 40 preferably accommodates edge portions of the sheet 62 so that the sheet 62 is flush with the surface 14.

Another embodiment of a compartment structure of the type shown in FIG. 4 is shown in FIGS. 22–27. Here again, corresponding parts are similarly numbered. Here the sheet 62 is received in a frame member 71 that is itself adapted to have its upper surface flush with the top surface 14 of platform 12. The frame member 71 is itself connected integrally with a plurality of C-configured, rigid, strap-like supports 72 (here two) each of whose opposed terminal arms is connected by screws, nails, or like fasteners to the adjacent portions of the side walls 56. The fasteners here extend through holes 73 formed in the supports 72, as shown. Depending upon the structure of the work station being utilized, the relationship between the frame member 71 and its strap-like supports 72 is preferably such that a flat monitor 60 can be side inserted into or removed from the compartment structure as associated with a platform 12 by sliding.

Figure 28:
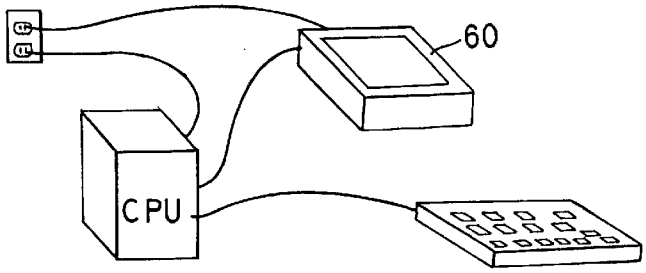
FIG. 28 is a simplified diagrammatic illustration exemplifying the manner in which a flat monitor, a central processing unit, and a keyboard can be electronically interconnected together in a work station of the present invention.
Figure 16:
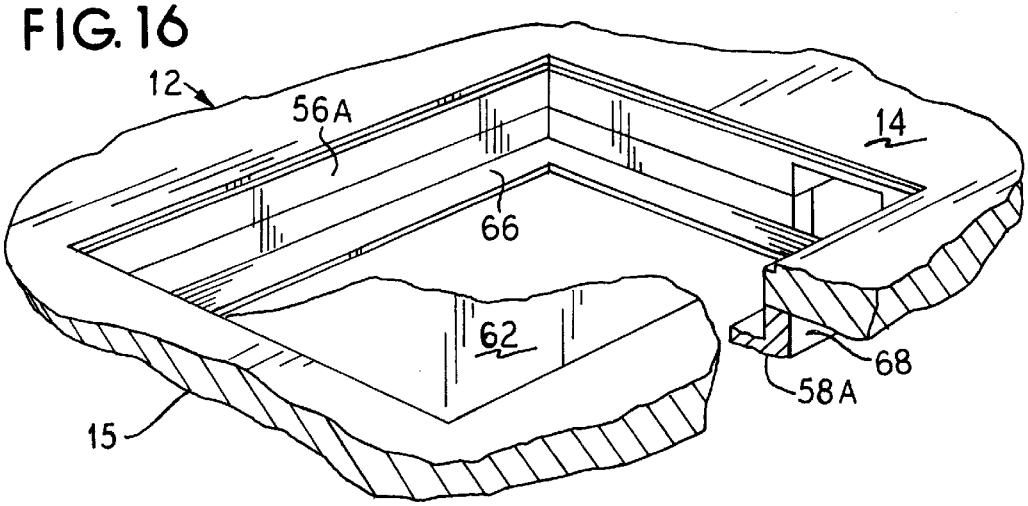
FIG. 16 is a fragmentary enlarged perspective view, some parts thereof broken away, showing an alternative embodiment of a compartment structure of the type shown in FIG. 4.
Figure 17:
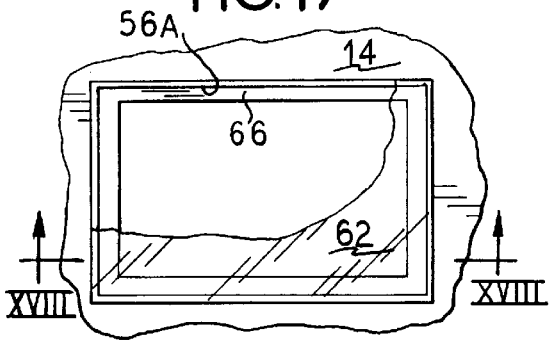
FIG. 17 is a top plan view of the structure shown in FIG. 16.
Figure 18:
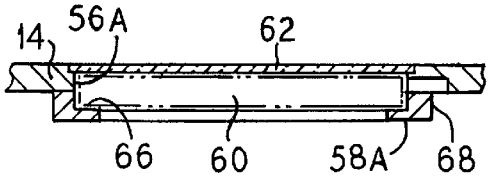
FIG. 18 is a vertical lateral sectional view taken along the line XVIII—XVIII of FIG. 17.
Figure 19:
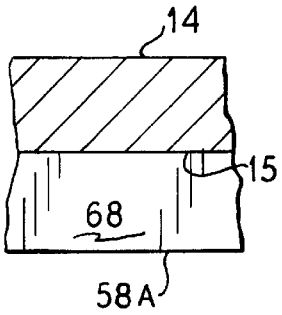
FIG. 19 is an enlarged fragmentary vertical sectional view through the platform looking towards a medial edge portion of the compartment structure shown in FIG. 18.
Figure 20:
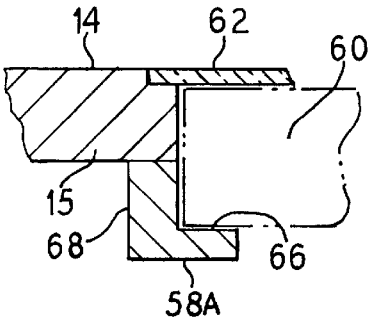
FIG. 20 is an enlarged fragmentary vertical sectional view through a portion of the platform and adjoining compartment structure shown in FIG. 18.
Figure 21:
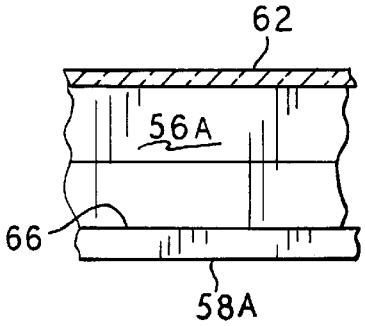
FIG. 21 is an enlarged, fragmentary vertical sectional view taken through the compartment structure shown in FIG. 18.
Figure 22:
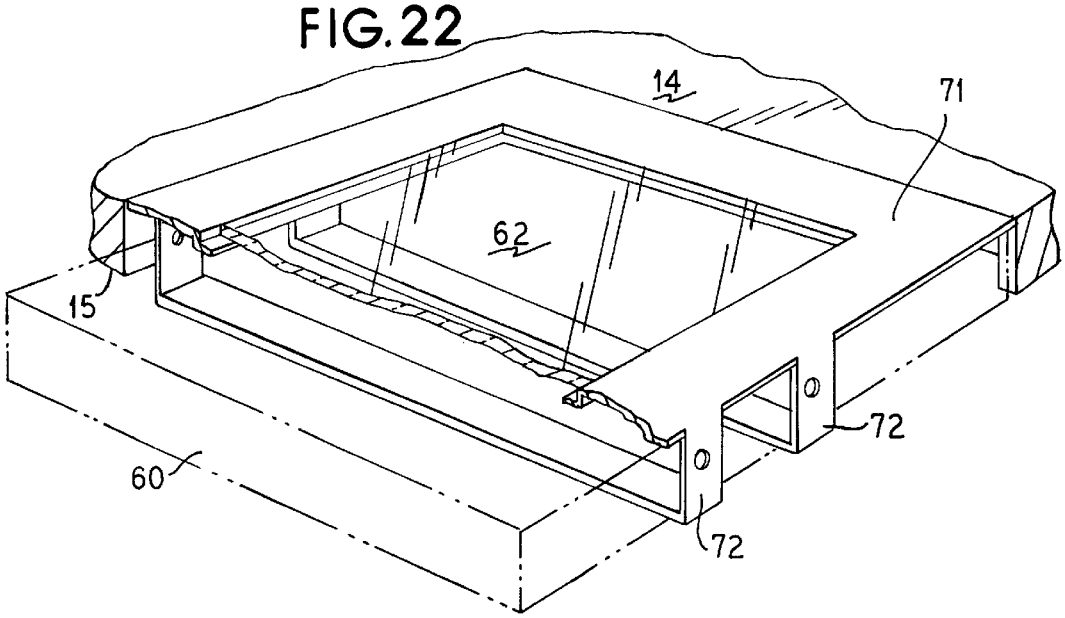
FIG. 22 is a view similar to FIG. 16 but showing a further alternative embodiment of a compartment structure.
Figure 23:
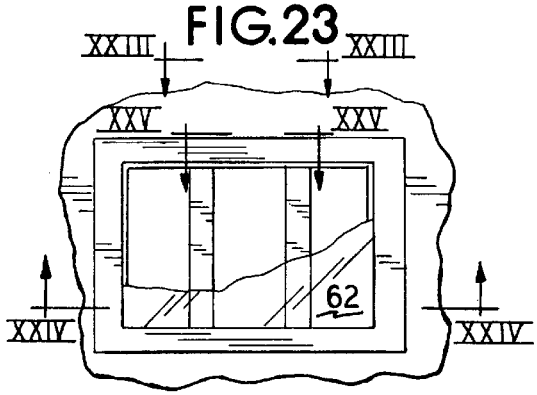
FIG. 23 is a top plan view of the structure shown in FIG. 22.
Figure 24:
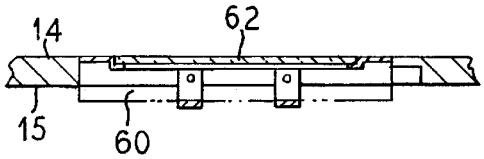
FIG. 24 is a vertical lateral sectional view taken along the line XXIV—XXIV of FIG. 23.
Figure 25:
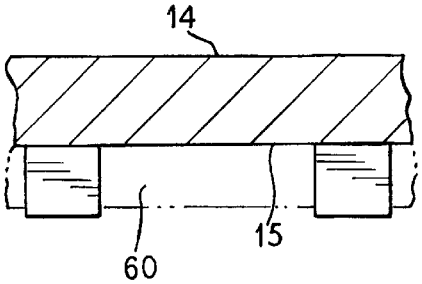
FIG. 25 is an enlarged fragmentary vertical sectional view through the platform looking towards a medial edge portion of the compartment structure shown in FIG. 24.
Figure 26:
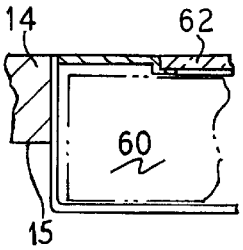
FIG. 26 is an enlarged fragmentary vertical sectional view through a portion of the platform and adjoining compartment structure shown in FIG. 24.
Figure 27:
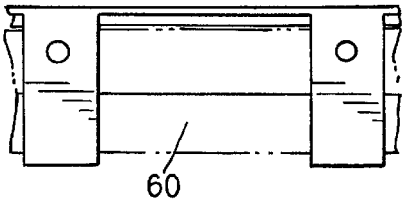
FIG. 27 is an enlarged fragmentary vertical sectional view taken through the compartment structure shown in FIG. 22 looking towards a medial edge portion thereof.

The typical manner in which a flat monitor, a keyboard and a CPU are interconnected together in a work station of the invention is illustrated by the self-explanatory diagram of FIG. 28. It is a feature of this invention that various flat monitors can be utilized with the inventive work station.

The foregoing description is for purposes of illustration only and no limitation on inventive scope is intended. The scope of inventive protection is to be measured by the following claims, which are to be interpreted as broadly as the inventive contribution and equivalent structures and elements permit.

The claimed invention is:

1. A work station for use with a computer system utilizing a flat monitor having a viewing screen in one side face thereof, the work station comprising a platform having a top surface and work station support means for supporting the platform in upwardly spaced relationship relative to a floor surface, the top surface having a compartment therein for receiving and supporting the flat monitor in spaced relationship to the top surface for viewability of the viewing screen by a user of the work station, the compartment being defined by a perimeter wall means and by flat monitor bottom surface support means, the flat monitor bottom surface support means including a generally flat monitor support member, wherein the flat monitor substantially is adapted to fill a cavity defined by said compartment.

2. The work station in claim 1 wherein the compartment has a generally quadrilateral perimeter and has an upper side defined by an opening in the top surface.

3. The work station of claim 1 wherein the work station support means comprises a pair of opposed end walls, each of said end walls being positioned adjacent to and associated with a different opposite end portion of the platform for supporting the platform, and the end walls define in combination with compartment-defining means that are located beneath the platform and between the end walls a knee-hole region beneath the platform, and wherein a keyboard supporting tray is horizontally located between and is slidingly engaged with one end wall and with the compartment defining means so that the tray is slidingly extendible from a first position that is disposed substantially within the knee-hole region and below but adjacent to the platform to a second and extended position that is outwardly disposed from the first position.

4. The work station of claim 3 wherein the keyboard supporting tray includes a pair of opposed lateral side walls.

5. The work station of claim 3 wherein each one of a pair of slide members is respectively horizontally mounted to one of said end walls and to the compartment defining means, wherein a rail member is horizontally mounted to each opposed lateral side wall of the keyboard supporting tray, and wherein each said rail member is slidingly engaged with an adjacent one of the slide members.

6. The work station of claim 3 wherein the compartment defining means comprises a third wall that is located between the end walls and wherein a drawer for receiving a central processing unit is horizontally mounted in laterally adjacent relationship to the keyboard supporting tray between one of said end walls and the third wall, the drawer having sides that are slidingly engaged with the third wall and with the one end wall so that the drawer is slidingly extendible from a first position beneath the platform to a second position that is outwardly extended from the first position.

7. The work station of claim 1 wherein a sheet of transparent material covers the compartment.

8. The work station of claim 7 wherein the upper surface of the sheet is substantially flush with the top surface of the platform.

9. The work station of claim 1 wherein the generally flat monitor support member of the flat monitor bottom surface support means comprises a ledge means that is associated with the bottom surface of the platform adjacent peripheral portions of the compartmental opening in the platform for supporting peripheral bottom edge portions of the flat monitor.

10. The work station of claim 9 wherein the ledge means extends continuously around the compartment periphery.

11. The work station of claim 10 wherein the ledge means comprises an abutment that is secured to the bottom surface of the platform and a shoulder that is integral with the abutment and that extends from the abutment for supporting the flat monitor.

12. The work station of claim 9 wherein the compartmental opening in the platform includes a channel means that is defined about the compartment perimeter walls adjacent to the top surface of the platform, and wherein a sheet of transparent material can cover the compartmental opening with a flat monitor positioned therein, with edge portions of the sheet being supported by the channel means whereby the outer surface of the sheet is substantially flush with the top surface of the platform.

13. A work station for use with a computer system utilizing a flat monitor having a viewing screen in one side face thereof, the work station comprising a platform having a top surface and work station support means for supporting the platform in upwardly spaced relationship relative to a floor surface, the top surface having a compartment therein for receiving and supporting the flat monitor for viewability of the viewing screen by a user of the work station, the compartment being defined by a perimeter wall means and by a generally flat support means, the flat support means including a generally flat monitor support portion extending therefrom at an upward angle, wherein the generally flat support means extends across bottom portions of said compartment with an interconnected upturned flange means defined along side portions thereof, and each of the flange means is adjacent to a different opposed flange perimeter wall portion of the compartmental opening defined in the platform, and each of the flange means includes fastening means for mounting the flange means to the adjacent perimeter wall portion, whereby at least the generally flat support means is suspended from the opposed perimeter wall portions of the compartmental opening defined in the platform.

* * * * *